United States Patent [19]

Rawlings et al.

[11] Patent Number: 4,933,026

[45] Date of Patent: Jun. 12, 1990

[54] SOFT MAGNETIC ALLOYS

[76] Inventors: Rees D. Rawlings, The Elms, 13 Wolverton Avenue, Kingston Upon Thames, Surrey KT2 7QF; Rodney V. Major, 4 Mount Close, Pound Hill, Crawley, Sussex RH10 4EF; Clive M. Orrock, 6 Cheal Close, Shoreham-by-Sea, West Sussex BN4 5RG, all of United Kingdom

[21] Appl. No.: 214,408

[22] Filed: Jul. 1, 1988

[30] Foreign Application Priority Data

Jul. 3, 1987 [GB] United Kingdom ..... 8715726

[51] Int. Cl.[5] ..... C22C 19/07; C22C 30/00

[52] U.S. Cl. ..... 148/311; 148/313; 148/315; 420/127; 420/435; 420/581

[58] Field of Search ..... 420/127, 435, 581; 148/311, 313, 315

[56] References Cited

U.S. PATENT DOCUMENTS 3,634,072 1/1972 Ackerman et al. ..... 420/581
4,116,727 9/1978 Major ..... 420/581

FOREIGN PATENT DOCUMENTS 44526 3/1980 Japan ..... 148/311

OTHER PUBLICATIONS

Bronner, C., "Semi-Permanent Alloys of the Iron-Cobalt-Tantalum Type," *Memoires Scientifiques de la Revue de Metallergie,* vol. 70, No. 12, pp. 961-967, Dec. 1973.

*Primary Examiner*—L. Dewayne Rutledge
*Assistant Examiner*—George Wyszomierski
*Attorney, Agent, or Firm*—Cumpston & Shaw

[57] ABSTRACT

A soft magnetic cobalt/iron alloy with high saturation magnetization comprising 0.15%-0.5% tantalum or niobium or tantalum plus niobium, 33-55% cobalt, the balance consisting of iron apart from very minor alloy ingredients and incidental impurities.

36 Claims, 2 Drawing Sheets

SOFT MAGNETIC ALLOYS

This invention relates to soft magnetic alloys with high saturation magnetisation.

A known group of magnetic alloys comprises 45–55% iron, 45–55% cobalt and 1.5 to 2.5% vanadium, with a preferred nominal composition of 49% Co, 2% V. This alloy has been used for some time for a variety of applications where a high saturation magnetisation is required, i.e. as a lamination material for electrical generators used in aircraft and pole tips for high field magnets.

Binary cobalt-iron alloys containing 33–55% cobalt are extremely brittle which is attributed to the formation of an ordered superlattice at temperatures below 730° C. The addition of about 2% vanadium inhibits this transformation to the ordered structure and permits the alloy to be cold-worked after quenching from about 730° C. The addition of vanadium also benefits the alloy in that it increases the resistivity, thereby reducing the eddy current losses. The iron-cobalt-vanadium alloy has generally been accepted as the best commercially available alloy for applications requiring high magnetic induction at moderately high fields.

The addition of 2% vanadium does have a drawback in that it reduces the magnetic saturation of the binary alloy by about 5%. This invention discloses the discovery of two alternative elements to vanadium which can be added in such small amounts as not to cause a significant drop in saturation and yet still inhibit the ordering reaction to such an extent that cold working is possible.

The alloys of the invention comprise 0.15% –0.5% tantalum or niobium or tantalum plus niobium, 33–55% cobalt, the balance consisting of iron apart from very minor alloy ingredients and incidental impurities. Minor alloying ingredients to assist deoxidation during melting may be present but should preferably be restricted to 0.3% manganese, 0.1% silicon and 0.03% carbon. Incidental impurities such as nickel should be restricted to 0.3% maximum total.

Figure 1:
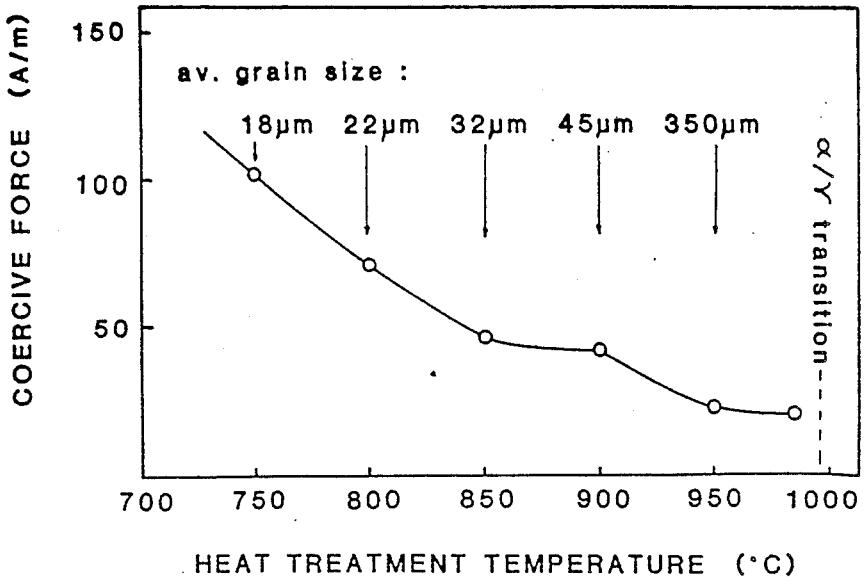
Figure 2:
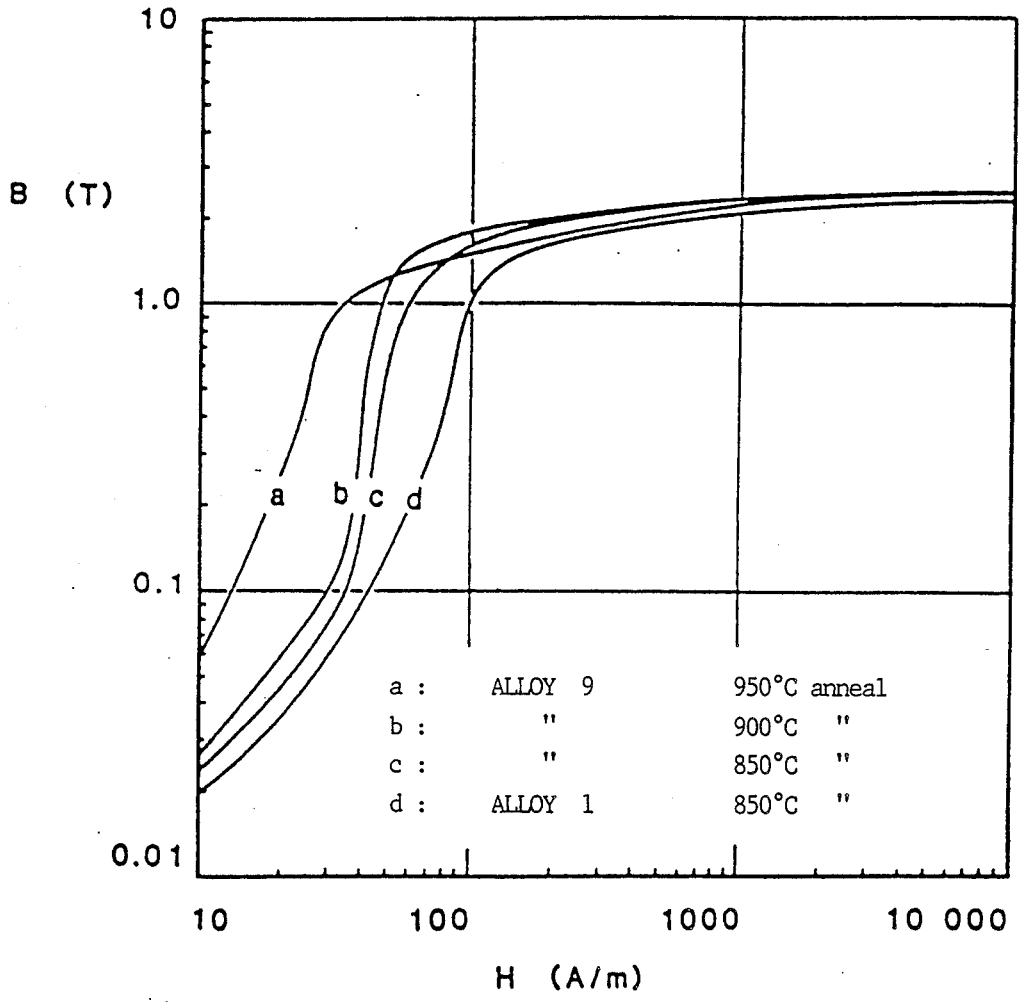

In the accompanying drawings:

FIG. 1 shows the relationship between heat treatment temperature and coercive force for an alloy containing 51.3% cobalt, 0.2% tantalum and balance iron; and FIG. 2 shows a series of DC Normal Induction Curves illustrating the results of annealing at different temperatures an alloy containing 51.3% cobalt, 0.2% tantalum and balance iron compared with an alloy containing 49.8% cobalt, 1.9% vanadium, balance iron.

The alloys listed in Table 1 were fabricated into 0.35 mm thick strip by the conventional technique for the known alloy, i.e. vacuum melting, hot rolling the cast ingot to 2.5 mm thick strip, reheating the strip to above the order-disorder temperature i.e. to around 800° C. and rapidly quenched into brine solution below 0° C. The time at temperature at 800° C. is minimised to restrict grain growth which can also impair the ductility of the strip.

TABLE 1

| | Composition (Wt. %) | | | | | |
|---|---|---|---|---|---|---|
| | Fe | Co | Ternary Addition | B40,000 A/M Tesla | Ductility | Alloy No. |
| (a) | Bal. | 49.8 | 1.9V | 2.34 | Ductile | 1 |
| | Bal. | 49.1 | 0.1 Nb | | Brittle | 2 |
| | Bal | 51.6 | 0.12 Nb | | Brittle | 3 |
| | Bal. | 34.8 | 0.25 Nb | 2.45 | Ductile | 4 |
| (b) | Bal. | 51.4 | 0.32 Nb | 2.44 | Ductile | 5 |

TABLE 1-continued

| | Composition (Wt. %) | | | | | |
|---|---|---|---|---|---|---|
| | Fe | Co | Ternary Addition | B40,000 A/M Tesla | Ductility | Alloy No. |
| | Bal. | 50.6 | 0.5 Nb | 2.41 | Ductile | 6 |
| | Bal. | 49.2 | 1.0 Nb | 2.28 | Ductile | 7 |
| | Bal. | 48.9 | 2.0 Nb | 2.20 | Ductile | 8 |
| (c) | Bal. | 51.3 | 0.2 Ta | 2.45 | Ductile | 9 |
| | Bal. | 34.9 | 0.3 Ta | 2.44 | Ductile | 10 |
| (d) | Bal. | 49.5 | 0.2 Ta + 2.1V | 2.35 | Ductile | 11 |

(a) = Vanadium alloy - standard for comparison
(b) = Niobium additions
(c) = Tantalum additions
(d) = Tantalum and Vanadium additions
B40,000 A/M is saturation magnetisation measured at a field of 40,000 amps per meter, in Tesla.

In Table 1

Section (a) relates to the standard vanadium alloy which is put in merely for comparison;

Section (b) shows alloys made up with niobium additions both within and without the range covered by the present invention;

Section (c) shows alloys with tantalum additions within the range covered by the present invention; and Section (d) shows, for comparison, an alloy, outside the scope of the present invention, containing both Tantalum and Vanadium.

The important comparison to be made here is between the saturation magnetisation expressed in Tesla and measured at a field of 40,000 amps per square metre, of the vanadium alloy in section (a) and the alloys in the other two sections. What is aimed at is to achieve a high saturation magnetisation combined with ductility.

It will be noted that alloys lying within the range of niobium addition of 0.15–0.5% are all ductile and have higher saturation magnetisation than the vanadium alloy. Similarly the tantalum alloys quoted are both ductile and have higher saturation magnetisation than the vanadium alloys.

The upper boundary of the ferromagnetic phase in binary iron-cobalt alloys containing 33 to 55 Wt. % cobalt is 960°/980° C. The addition of vanadium lowers the boundary in the 49/49/2 FeCoV alloy to between 865° C. and 895° C. A paramagnetic phase forms above this and is therefore the upper temperature limit for useful operation and heat treatment of the alloy.

Additions of niobium or tantalum within the scope of this invention are found to lower the transition temperature very little. This has important consequences since it permits heat treatment and operation at temperatures up to 100° C. above that for 2% V alloy.

The influence of heat treatment temperature on the magnetic properties of alloy 9 is shown in FIGS. 1 and 2. Lower coercive force and improvement in permeability can be achieved by heat treating at the higher temperatures of 950° C.

This is also illustrated in Table 2 in a comparison between alloys 9, containing 0.2% tantalum and no vanadium, and alloy 11 containing 0.2% tantalum and 2.1% vanadium, which were both heat treated for 2 hours in pure dry hydrogen at temperatures between 750° C. and 950° C. and measurements made of coercive force.

It can be seen that the presence of vanadium in alloy 11 results in a high coercive force when heat treatment is carried out at 950° C. whereas alloy 9 with the same amount of tantalum and no vanadium can be heat treated at this temperature and produces a very low coercive force.

TABLE 2

| Alloy Number | Coercive Force A/m | | |
|---|---|---|---|
| | 750° C. | 850° C. | 950° C. |
| 9 | 100 | 45 | 22 |
| 11 | 87 | 66 | 114 |

In the following claims all % are expressed in Wt. %.

We claim:

1. A soft magnetic cobalt/iron alloy with high saturation magnetization which consists by weight essentially of about 0.15% -0.5% in total of tantalum and/or niobium, 33-55% cobalt, the balance consisting of iron apart from very minor alloy ingredients and incidental impurities.

2. An alloy according to claim 1 and in which the minor alloying ingredients assist deoxidation during melting of said alloy and are restricted to a maximum of 0.3% manganese, a maximum of 0.1% silicon and a maximum of 0.03% carbon.

3. An alloy according to claim 2 in which the incidental impurities are restricted to 0.3% maximum total.

4. An alloy according to claim 3 in which nickel is present as one of the incidental impurities.

5. An alloy according to claim 4 containing 0.2 to 0.4% in total of tantalum and niobium.

6. An alloy according to claim 5 which is ductile and has a saturation magnetization within the range 2.41 to 2.45 Tesla measured at 40,000 amps per meter.

7. An alloy according to claim 5 which has been heat treated at temperatures in the range 895° C. to 950° and exhibiting a coercive force of less than 50 A/m.

8. An alloy according to claim 4 which is ductile and has a saturation magnetization within the range 2.41 to 2.45 Tesla measured at 40,000 amps per meter.

9. An alloy according to claim 4 which has been heat treated at temperatures in the range 895° C. to 950° and exhibiting a coercive force of less than 50 A/m.

10. An alloy according to claim 3 containing 0.2 to 0.4% in total of tantalum and niobium.

11. An alloy according to claim 10 which is ductile and has a saturation magnetization within the range 2.41 to 2.45 Tesla measured at 40,000 amps per meter.

12. An alloy according to claim 10 which has been heat treated at temperatures in the range 895° C. to 950° and exhibiting a coercive force of less than 50 A/m.

13. An alloy according to claim 3 which is ductile and has a saturation magnetization within the range 2.41 to 2.45 Tesla measured at 40,000 amps per meter.

14. An alloy according to claim 3 which has been heat treated at temperatures in the range 895° C. to 950° and exhibiting a coercive force of less than 50 A/m.

15. An alloy according to claim 2 containing 0.2 to 0.4% in total of tantalum and niobium.

16. An alloy according to claim 15 which is ductile and has a saturation magnetization within the range 2.41 to 2.45 Tesla measured at 40,000 per meter.

17. An alloy according to claim 15 which has been heat treated at temperatures in the range 895° C. to 950° and exhibiting a coercive force of less than 50 A/m.

18. An alloy according to claim 2 which is ductile and has a saturation magnetization within the range 2.41 to 2.45 Tesla measured at 40,000 amps per meter.

19. An alloy according to claim 2 which has been heat treated at temperatures in the range 895° C. to 950° and exhibiting a coercive force of less than 50 A/m.

20. An alloy according to claim 1 in which the incidental impurities are restricted to 0.3% maximum total.

21. An alloy according to claim 20 in which nickel is present as one of the incidental impurities.

22. An alloy according to claim 21 containing 0.2 to 0.4% in total of tantalum and niobium.

23. An alloy according to claim 22 which is ductile and has a saturation magnetization within the range 2.41 to 2.45 Tesla measured at 40,000 amps per meter.

24. An alloy according to claim 22 which has been heat treated at temperatures in the range 895° C. to 950° and exhibiting a coercive force of less than 50 A/m.

25. An alloy according to claim 21 which is ductile and has a saturation magnetization within the range 2.41 to 2.45 Tesla measured at 40,000 amps per meter.

26. An alloy according to claim 21 which has been heat treated at temperatures in the range 895° C. to 950° and exhibiting a coercive force of less than 50 A/m.

27. An alloy according to claim 20 containing 0.2 to 0.4% in total of tantalum and niobium.

28. An alloy according to claim 27 which is ductile and has a saturation magnetization within the range 2.41 to 2.45 Tesla measured at 40,000 amps per meter.

29. An alloy according to claim 27 which has been heat treated at temperatures in the range 895° C. to 950° and exhibiting a coercive force of less than 50 A/m.

30. An alloy according to claim 20 which is ductile and has a saturation magnetization within the range 2.41 to 2.45 Tesla measured at 40,000 amps per meter.

31. An alloy according to claim 20 which has been heat treated at temperatures in the range 895° C. to 950° and exhibiting a coercive force of less than 50 A/m.

32. An alloy according to claim 1 containing 0.2 to 0.4% in total of tantalum and niobium.

33. An alloy according to claim 32 which is ductile and has a saturation magnetization within the range 2.41 to 2.45 Tesla measured at 40,000 amps per meter.

34. An alloy according to claim 32 which has been heat treated at temperatures in the range 895° C. to 950° and exhibiting a coercive force of less than 50 A/m.

35. An alloy according to claim 1 which is ductile and has a saturation magnetization within the range 2.41 to 2.45 Tesla measured at 40,000 amps per meter.

36. An alloy according to claim 1 which has been heat treated at temperatures in the range 895° C. to 950° and exhibiting a coercive force of less than 50 A/m.

* * * * *